US011781348B2

(12) United States Patent
Schuft

(10) Patent No.: US 11,781,348 B2
(45) Date of Patent: Oct. 10, 2023

(54) ADJUSTABLE SECURITY BRACKET

(71) Applicant: Mobile Tech, Inc., Hillsboro, OR (US)

(72) Inventor: Peter Schuft, Portland, OR (US)

(73) Assignee: Mobile Tech, Inc., Hillsboro, OR (US)

( * ) Notice: Subject to any disclaimer, the term of this patent is extended or adjusted under 35 U.S.C. 154(b) by 324 days.

(21) Appl. No.: 17/154,244

(22) Filed: Jan. 21, 2021

(65) Prior Publication Data

US 2021/0230910 A1 Jul. 29, 2021

Related U.S. Application Data

(60) Provisional application No. 62/965,376, filed on Jan. 24, 2020.

(51) Int. Cl.
*E05B 73/00* (2006.01)
*A47F 5/10* (2006.01)

(52) U.S. Cl.
CPC ..... *E05B 73/00* (2013.01); *A47F 5/106* (2013.01)

(58) Field of Classification Search
CPC ..... E05B 73/00; A47F 5/106
See application file for complete search history.

(56) References Cited

U.S. PATENT DOCUMENTS

| | | | | |
|---|---|---|---|---|
| 8,814,128 | B2 * | 8/2014 | Trinh | F16M 13/00 340/568.2 |
| 8,833,716 | B2 * | 9/2014 | Funk | F16M 13/022 248/316.4 |
| 9,303,809 | B2 * | 4/2016 | Reynolds | F16M 11/041 |
| 9,797,543 | B2 * | 10/2017 | Lin | F16M 13/00 |
| 9,972,178 | B2 * | 5/2018 | Richardson | G06Q 30/0185 |
| 10,001,153 | B1 * | 6/2018 | Fan | F16M 13/00 |
| 10,176,345 | B2 * | 1/2019 | Sedon | G06F 1/1632 |
| 10,448,759 | B1 * | 10/2019 | Chapuis | F16B 2/10 |
| 10,624,471 | B2 * | 4/2020 | Galant | F16M 13/00 |
| 10,858,865 | B2 * | 12/2020 | Kelsch | E05B 73/0017 |
| 11,015,626 | B2 * | 5/2021 | Leyden | E05B 73/0082 |
| 2012/0312936 | A1 * | 12/2012 | Huang | F16M 11/041 248/316.1 |
| 2013/0301216 | A1 * | 11/2013 | Trinh | A47F 7/0246 361/679.58 |
| 2014/0060218 | A1 * | 3/2014 | Bisesti | G01D 11/245 248/274.1 |
| 2016/0201359 | A1 * | 7/2016 | Berglund | E05B 47/0009 70/58 |
| 2019/0249697 | A1 * | 8/2019 | Liu | H02J 50/10 |

* cited by examiner

*Primary Examiner* — Monica E Millner

(57) ABSTRACT

Systems are directed securing products to merchandise security systems. A merchandise security system comprises an adjustable bracket for securing a product. The bracket comprises three adjustable bracket arms, a base having a surface for receiving the product, and a lock. Each of the adjustable bracket arm extends outward from the base and are adapted to engage with a portion of the product to facilitate securing the product to the base.

17 Claims, 13 Drawing Sheets

ADJUSTABLE SECURITY BRACKET

CROSS-REFERENCE TO RELATED APPLICATION

This application claims the benefit of Provisional Application No. 62/965,376, filed Jan. 24, 2020.

TECHNICAL FIELD

The present disclosure is directed to secure product merchandising systems.

BACKGROUND

Selling products in a retail setting is a balance between a seller's desire to create customer interest in products on display by allowing customers to inspect and handle the products and the seller's need to ensure that the products are not stolen. Retail sales of small electronic devices, such as cell phones, tablets, cameras, and wearable electronics, are often placed on display tables in large open retail settings, enabling customers an opportunity to inspect many different models by simply walking from table to table. However, because these products can be easily concealed and stolen in a crowded open retail setting, products are secured to display tables using merchandising systems that are constructed to prevent theft of the products on display. A typical merchandising system comprises a puck and a base secured to a display table or shelf. A product is attached to the puck and a tether connects the puck to a self-winding reel located within the base. When a customer lifts a product to examine the product's features, the product is held under tension by the self-winding reel.

Retailers have relied on typical merchandising systems to deter theft of the attached products. However, there is no industry size standard for electronic products in many categories. Smart phones, for example, have a generally rectangular design, but the exact dimensions of the phone, touchscreen, and visible display varies greatly between manufacturers. As a result, electronic products are often attached to pucks using an adhesive. However, thieves have learned that large forces can be used to separate a product from a puck, creating additional security problems for retailers that sell a variety of electronic products. Thus, there is a need for security products that provide a high degree of mechanical security for a wide range of product dimensions and designs that resist attacks by thieves.

SUMMARY

Systems for securing products to a merchandise security system are described herein. In one aspect, a merchandise security system comprises an adjustable bracket for securing a product. The bracket comprises an adjustable bracket arm, a base having a surface for receiving the product, and a lock. The adjustable bracket arm extends outward from the base and is adapted to engage with a portion of the product to facilitate securing the product to the base. The lock can have an unlocked state for the lock, a first locked state for the lock, and a second unlocked state for the lock to control whether the adjustable bracket arm can be extended and retracted relative to the base. The adjustable bracket arm can be extended and retracted relative to the base when the lock is in the unlocked state. The adjustable bracket arm cannot be extended or retracted relative to the base when the lock is in the first locked state or the second locked state. The unlocked state corresponds to an unlocked position for the lock that arises when there is no force being applied to the lock to transition the lock to either of the first or second locked states. The first locked state corresponds to a first locked position for the lock that arises when a force external to the base is applied to the lock to move the lock from the unlocked position to the first locked position. The lock automatically returns to the unlocked position from the first locked position in response to the external force being removed from the lock, and the second locked state corresponds to a second locked position for the lock that arises when the base applies a force to the lock to hold the lock in the second locked position. With the existence of two different locking states for the lock, users are provided with more flexibility for manipulating the adjustable security bracket.

DETAILED DESCRIPTION

Figure 1:
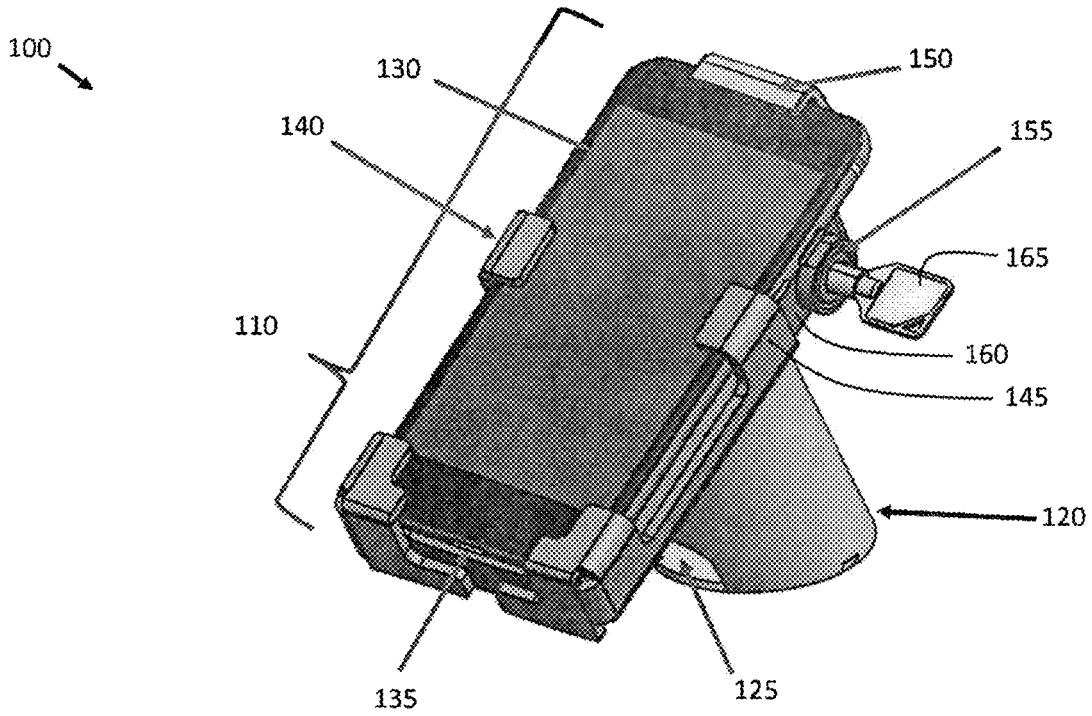
FIG. 1 illustrates an example merchandise security system that includes an example adjustable bracket with an attached electronic device in accordance with an example embodiment.
Figure 2:
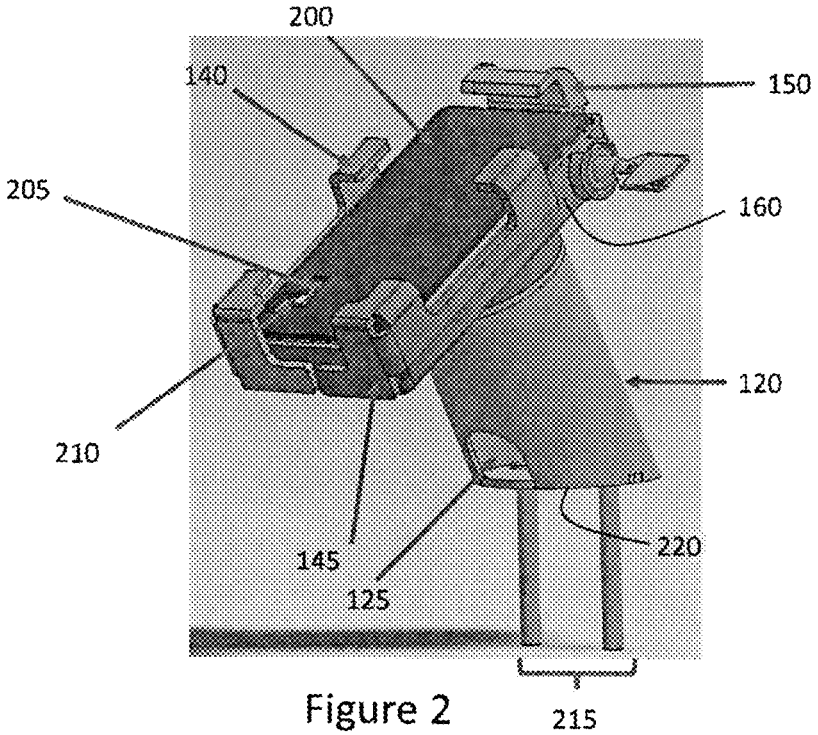
FIG. 2 illustrates the example merchandise security system of FIG. 1 without an attached electronic device.

FIGS. 1 and 2 illustrates an example merchandise security system 100. FIG. 1 shows the merchandise security system 100 securing an electronic device 130. FIG. 2 shows the merchandise security system 100 without the electronic device 130. The merchandise security system 100 may include an adjustable bracket 110 and a display base 120. The display base 120 may be configured to support the adjustable bracket 110 in a set position. As shown in FIGS. 1 and 2, the adjustable bracket 110 may be in an angled position relative to a surface on which the merchandise security system 100 is positioned. In other embodiments, the display base 120 may allow the adjustable bracket 110 to be positioned perpendicular to the surface on which the system 100 is positioned. The display base 120 may be positioned on or attached to any type of surface, such as a table, shelf, cabinet, wall, etc. that is capable of supporting the display base 120. The display base 120 may also have a display base aperture 125 through which cables may pass. In some instances, the electronic device 130 secured by the adjustable bracket 110 may require power through a port 135. Power cables (and/or cables with alarming functionality)

may pass through the display base 120 and through display base aperture 125 before plugging into port 135 of the electronic device 130.

The display base 120 may contain monitoring electronics that can be used to monitor the connection between the adjustable bracket 110 and the display base 120 as well as connections between power cables (and/or cables with alarming functionality) and port 135. As shown in FIGS. 1 and 2, the adjustable bracket 110 can be directly connected to the display base 120. However, in other embodiments, a puck may intervene between the display base 120 and the adjustable bracket 110. The puck could then attach to the display base 120 by way of a display base lock or by way of a tether connected to the puck and housed within the display base 120. At the opposite end, the puck may attach to the adjustable bracket 110 by way of a strong adhesive or other locking mechanism. There may also be alarming electronics within the puck that communicate with the display base 120. If the puck is detached from the adjustable bracket 110, a sensor of the puck may provide an alarming signal to the monitoring electronics within the display base 120 to activate an alarming condition. Examples of designs for pucks and display bases and other features that support this type of functionality are described in U.S. Pat. Nos. 8,558,688, 8,698,617, 8,698,618, 9,786,140; 10,026,281, and U.S. Publication Nos. 2017/0164314, 2017/0300721, 2018/0049563, and 2018/0288720, the entire disclosures of each of which are incorporated herein by reference.

For a frame of reference in the discussions below with respect to various components of the disclosed example embodiments for the adjustable bracket 110, it should be understood that terms such as "upper," "top," "higher," and "upward," refer to a directional relationship that is toward the product-mounting surface of the bracket 110 (and beyond), while terms such as "lower", "bottom", and "downward" refer to a directional relationship that is toward the display base 120 (or table/surface on which the display base 120) is positioned. "Vertical" refers to the dimension for the bracket assembly 110 that extends from upper portions to lower portions, and "horizontal" refers to the dimension that is orthogonal to the vertical dimension, even if the bracket 110 is displayed at a tilted angle (such as shown by FIG. 1). Furthermore, the electronic device 130 to be secured by the bracket 110 can generally be thought of as having a 3D rectangular shape where the lateral dimensions are larger than its thickness dimension. For a frame of reference for purposes of discussion, the first lateral dimension of the electronic device 130 can be called product length and refer to the longer lateral dimension of the electronic device 130 as shown by FIG. 1. The second lateral dimension of the electronic device 130 can be called the product width and refer to the shorter lateral dimension of the electronic device 130 as shown by FIG. 1. As noted above, an example of a suitable electronic device 130 is an electronic device such as a smart phone, which generally exhibits a product length greater than its product width, and a product thickness significantly less than its product length and product length. Subsequent discussions to follow will focus on example embodiments of the bracket 110 that are designed to secure products 130 in the form of electronic devices such as smart phones. However, it should be noted that dimension components of the bracket 110 can be of different sizes and shapes in order to secure products 130 of different dimensions. But, for ease of reference with the example embodiments described below, the electronic device 130 will be referred to as an electronic device 130.

As shown in FIGS. 1 and 2, the adjustable bracket 110 comprises a first bracket arm 140, a second bracket arm 145, and a third bracket arm 150 that are shaped and positioned to encompass multiple edges of the electronic device 130. Bracket arms 140, 145, and 150 are each adjustable in that they can be extended and retracted relative to bracket bottom plate 160 (see FIG. 2) so as to change the product dimensions that the bracket assembly 110 is able to secure. Innovative mechanisms for these adjustments are discussed below.

Bracket bottom plate 160 can serve as a base on which the electronic device 130 rests or is mounted when secured by the bracket 110. Bracket arms 140 and 145 can be used to secure the electronic device 130 along sides of product width dimension and one of the sides of the product length dimension (the side opposite side engaged by bracket 150). For example, each bracket arm 140 and 145 can include a portion that secures a corner of the electronic device 130 (see FIGS. 1 and 2; see also FIGS. 6 and 7). However, in other example embodiments, the bracket 110 could be configured with a fixed member that engages with the side of the electronic device 130 opposite the side engaged by bracket arm 150, in which case bracket arms 140 and 145 would only need to be shaped to engage opposite sides of the product width dimension of the electronic device 130.

Bracket arm 150 can be used to secure the electronic device 130 along one of the sides of product length dimension. However, in other example embodiments, bracket arm 150 could also be shaped and configured to secure one of the sides of the product length dimension and both of the sides of the product width dimension (for example, bracket arm 150 could include portions that secures each corner of the electronic device 130 that shares the product length side also secured by bracket arm 150).

In an example embodiment, a first lock 155 can be used to lock bracket arm 150 at a desired position, and a second lock 210 (see, e.g., FIG. 2) can be used to lock bracket arms 140 and 145 at desired positions. A tool 165 such as a key may be used to operate lock 155. For example, in an example embodiment where lock 155 is a barrel lock, the tool 165 can be a key that can rotate the barrel lock from a locked to an unlocked position to permit adjustment of bracket arm 150 as well as rotate the barrel lock from an unlocked position to a locked position to block further adjustment of bracket arm 150. FIGS. 1 and 2 show that lock 210 is positioned to be accessible from the surface of the bottom plate 160 on which the electronic device 130 is mounted/secured, and that lock 155 is positioned to be accessible from a surface of the bottom plate 160 that serves as a sidewall for the bottom plate 160.

Turning now to FIG. 2, the merchandise security system 100 is viewed without a secured electronic device 130. Without the electronic device 130 blocking the view, more of the bottom plate 160 can be seen. For example, FIG. 2 shows a top plate cover 200 that can define an upper surface of the bottom plate 160 on which the electronic device 130 rest when secured by the bracket 110. In an example embodiment, the top plate cover 200 may be made of a slip resistance material such as a foam rubber cushion that pros ides additional support and grip for the electronic device 130 when secured by the bracket 110. In other example embodiments, the top place cover 200 may be able to deform in shape so that a more secure fit is maintained when the electronic device 130 is contacting each the top plate cover 200, bracket arm 140, bracket arm 145, and bracket arm 150. However, it should also be understood that for other example embodiments, the top plate cover 200 may be omitted, in which case the electronic device 130 would rest on the upper surface of top plate 300 (see FIG. 3).

The top plate cover 200 may have a top plate cover opening 205. The top plate cover opening 205 may align with a top plate opening 312 in the top plate 300 (see FIG. 3). The top plate cover opening 205 allows for an upper portion of lock 210 to protrude above the top place cover 200. Lock 210 can then be manipulated by the user or by placement of the electronic device 130 on the upper surface of the top plate cover 200 to thereby move lock 210 to a locked position that locks bracket arms 140, 145, and 150 into a set position.

FIG. 2 also shows an example where the display base 120 includes a plurality of display base fasteners 215. The display base fasteners 215 may be bolts, screws, or any securing measure that allows attachment of the display base 120 to the display surface. The display base fasteners 215 may attach to the display base bottom 220 and continue in a downward direction. When the merchandise security system 100 is to be secured on to a display surface, the display base fasteners 215 may travel through the display surface and may allow for placement of a securing mechanism such as a nut or washer, which can be tightened to secure the display base 120 to the display surface. Securing the display base 120 to the display surface in this manner can help to reduce the risk of theft of the electronic device 130.

Figure 3:
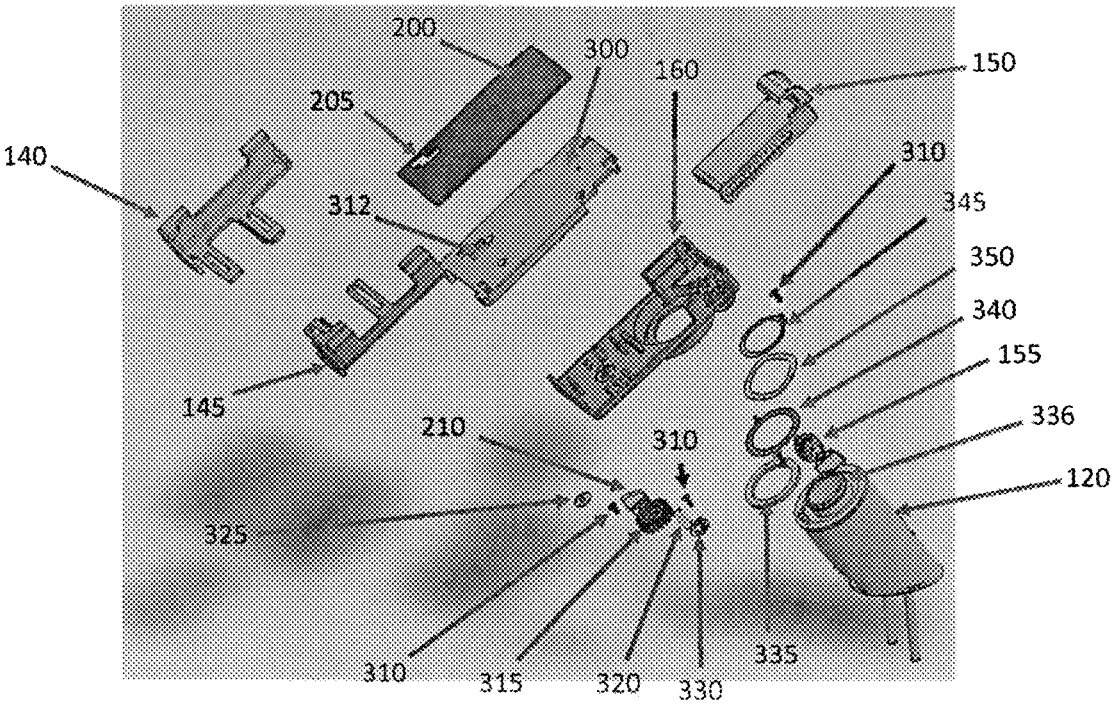
FIG. 3 illustrates an exploded view of the merchandise security system of FIG. 2.

FIG. 3 illustrates an exploded view of the merchandise security system 100. In this exploded view, each individual component of the merchandise security system 100 of the example embodiment of FIGS. 1 and 2 can be seen. For example, fuller version of example embodiments for bracket arms 140, 145, and 150 are shown in FIG. 3. FIG. 3 also shows the bottom plate 160 (FIG. 2) comprising a top plate 300 and a bottom plate 160. Top plate 300, bottom plate 160, and bracket arms 140, 145, 150 can be made from metal materials (such as steel) or other suitable high strength materials that are suitable for strong and durable for holding up over time and withstanding potentially forceful attacks by thieves.

Top plate cover 200 can be attached to the top surface of the top plate 300. For example, the top plate cover 200 can be attached by an adhesive to secure the top plate cover 200 to the top plate 300. Both the top plate 300 and the bottom plate 160 may be held together by one or more fasteners 310. The fastener(s) 310 may be one or more screws, rivets, or threaded rods. The contours of the top plate 300 and the bottom plate 160 can be shaped to hold and contain the internal components of the bracket 110. The shape and structure of top plate 300 and bottom plate 160 are discussed below with reference to FIGS. 4, 5, 9, and 10.

The internal components housed in the one or more interior chambers that exist between the top plate 300 and the bottom plate 160 of the bracket 110 include a gear 315 and a portion of lock 210. A spring 320 may be placed below the lock 210 to bias the lock 210 to an unlocked state as discussed below. When the lock 210 is pushed downward to a locked state, the spring 320 is compressed, as discussed below.

When lock 210 is in the locked state, the lock 210 interacts with gear 315 to prevent rotation of the gear 315. Because adjustment of bracket arms 140 and 145 rely on the rotation of gear 315, this blocking of rotation by the gear 315 prevent bracket arms 140 and 145 from further extension or retraction when the lock 210 is in the locked state.

Gear 315 is also an internal component that can placed between the top plate 300 and the bottom plate 160. A top spacer 325 may be placed on the top surface of the gear 315 and a bottom spacer 330 may be placed on the bottom surface of the gear 315. The top and bottom spacers 325 and 330 provide additional clearance for the gear 315 relative to the top plate 300 and bottom plate 160 and allow the gear 315 to rotate when the bracket arms 140 and 145 are extended or retracted.

At least one washer 340, 335 can be used to provide bearing surfaces between bottom plate 160 and display base 120. At least one spring 350 may be used to provide proper rotational resistance between bottom plate 160 and display base 120. A lock ring 345 may be used to attach bottom plate 160 to display base 120 in a manner that does not prevent rotation. The lock ring 345 may be seated in a rectangular groove cut circumferentially in the display base 120. A set screw (not shown) can be used to rotationally lock into one of multiple possible positions. Two possible positions for the bracket 110 are portrait orientation and landscape orientation. The set screw may protrude into one or more holes in the display base 120 that prevent rotation of the bracket 110.

Figure 4:
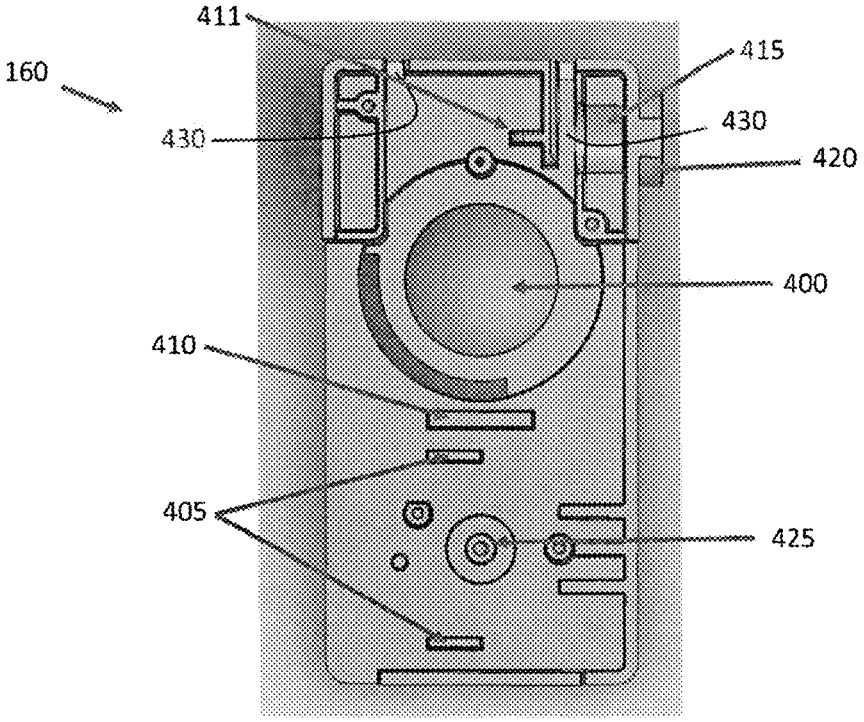
FIG. 4 illustrates a top down view of an example bottom plate for an example adjustable bracket.

FIG. 4 shows a top-down view of an example embodiment for bottom plate 160. A bottom plate aperture 400 is located in an upper middle portion of the bottom plate 160. The bottom plate aperture 400 may have a larger diameter than a display base fitting of the display base 120. When positionally attached to the display base 120, the bottom plate aperture 400 may slip over the display base fitting 336 and then be attached to the display base 120 by at least one fastener 310. Although not shown in the example of FIG. 4, there may be additional designs where electronics can be included among the internal components of the bracket 110. In such a design, electronic cables may be present and come up through the bottom plate aperture 400 to connect to these electronics within the bracket 110.

The bottom plate 160 may also have a plurality of guide rails 405 that provide sliding engagement for extension/retraction movements or bracket arms 140, 145. As an example, these guide rails 405 may take the form of tabs that protrude outward from the bottom plate 160 and fit within slots 610, 710 of bracket arms 140, 145 (see FIGS. 6 and 7). The bracket arms 140 and 145 may be positioned to fit over different ones of the guide rails 405. The interaction of guide rails 405 with the bracket arms 140, 145 not only ensures that the extension/retraction of bracket arms 140, 145 follows a linear course but also defines a maximum extension permitted for the bracket arms 140, 145 to prevent bracket arms 140, 145 from being pulled completely out of and separating from the bottom plate 160. While the example shown herein has guide rails 405 positioned on bottom plate 160, it should be understood that the guide rails 405 could alternatively be positioned on top plate 300.

Figure 8:
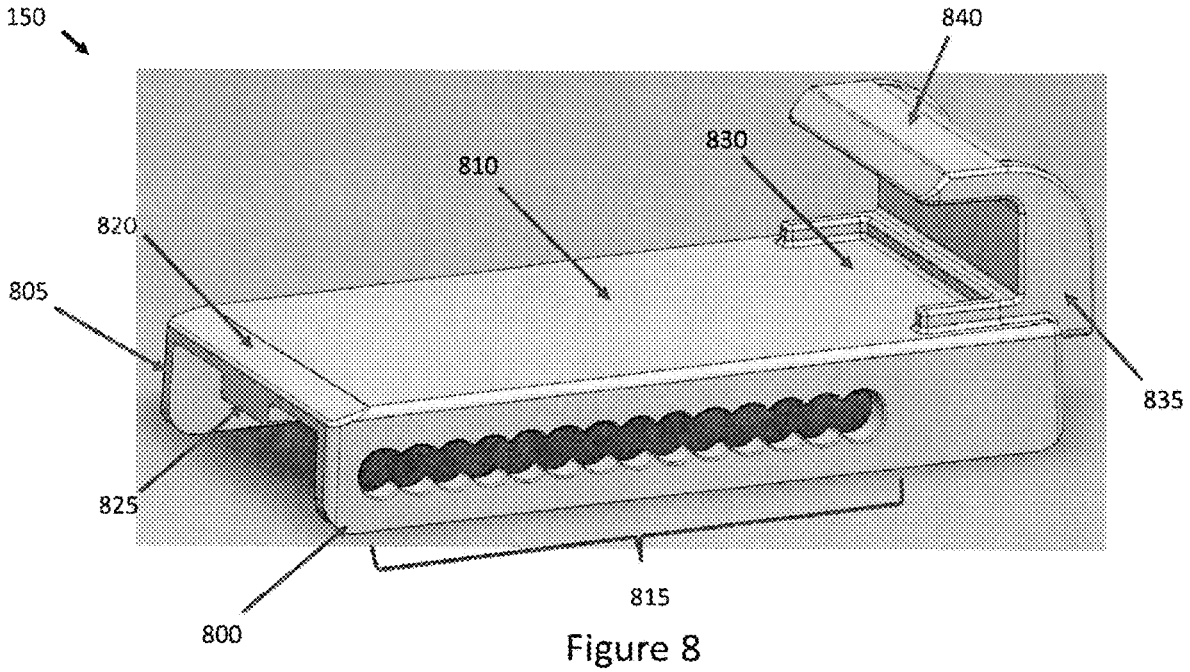

Bottom plate 160 may also include rail slots 430 the provide pathways for sliding movement of rails 800, 805 on bracket arm 150 (see FIG. 8) when bracket arm 150 extends/retracts. While FIGS. 3 and 8 show examples where the rails are on the bracket arm 150 and the slots 430 are in the bottom plate, it should be understood that slots 430 could alternatively be included as part of top plate 350. Furthermore, in another example embodiment, the rails could be included as part of bottom plate 160 or top plate 300 while the slots are part of bracket arm 150.

FIG. 4 also shows stops 410 and 411 that are provided as part of the bottom plate 160 and protrude outward from the bottom plate 160 to define a maximum extent of retraction for the bracket arm 150. The stop 410 can help maintain separation between bracket arm 150 and either of the bracket arms 140, 145. The stop 411 prevents the bracket arm 150 from being pull out of the bracket 110 as described below with reference to FIG. 8. While FIG. 4 shows stop 410 as being part of the bottom plate 160, it should be understood that stop 410 may be alternately positioned as part of top plate 300.

FIG. 4 further shows a spindle 425 that can be included as part of the bottom plate 160. The spindle 425 protrude outward from the upper surface of the bottom plate 160. The spindle 425 has a diameter that fits within hole of the gear 315 and the top and bottom spacers 325 and 330. In an example embodiment, the bottom spacer 330 may first be placed on the spindle 425, followed by the gear 315, and finally followed by the top spacer 325. A fastener 310 can then be used to secure all of these components to the spindle 425 and the bottom plate 160. When so attached, the gear 315 can rotate around the axis of the spindle 425. While FIG. 4 shows the spindle 425 as part of the bottom plate 160, it should be understood that spindle 425 may be part of top plate 300.

FIG. 4 also shows the bottom plate 160 includes a lock holding region 415 shaped to hold the lock 155 (see FIG. 3) within the bracket 110. While the example of FIG. 4 shows the lock holding region 415 as being shaped to hold a barrel lock, it should be understood that other types of locks may be used for lock 155, and the shape of lock holding region 415 can be selected to fit those particular dimensions. A lock protector 420 protrudes from a side of the bottom plate 160. As an example, lock protector 420 may take the form of a mechanical boss within which a portion of the lock 155 resides. The lock protector 420 may be formed as part of the bottom plate 160 and helps protect the integrity of lock 155 against thieves, for example by reducing the ability of a thief who may use a tool in an attempt to pry the lock 155 out of lock holding region 415. To combat this issue, the lock protector 420 extends away from the side of the bottom plate 160 to encase portions of the lock 155 and reduce any leverage a thief might have in an attempt to break or pop the lock 155.

Figure 5:
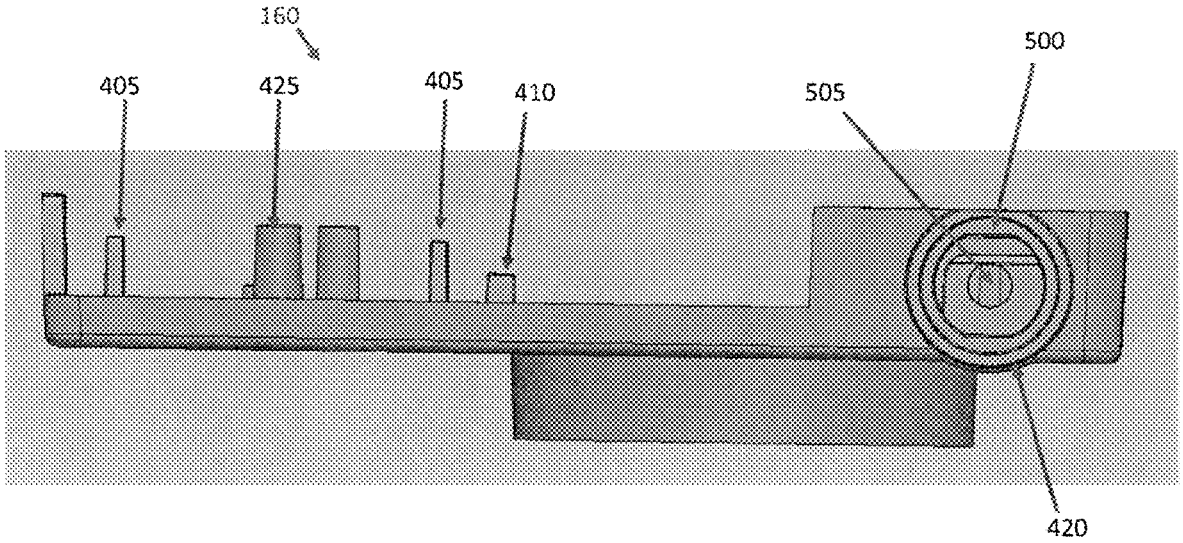
FIG. 5 illustrates a side view of the bottom of FIG. 4.

FIG. 5 is a side view of the bottom plate 160. This side view shows the spindle 425, guide rails 405, and stop 410 protrude outward from the upper surface of bottom plate 160. Also shown in FIG. 5 is the lock protector 420. The lock protector 420 can define a recess which can serve as a lock resting region 500. This lock resting region 500 allows the lock 155 to fit snugly inside the lock proctor 420. A piston aperture 505 is located at the inner edge of the lock protector 420. The piston aperture 505 is an opening through which a piston 1100 of the barrel lock (see FIG. 11) may pass to engage with the bracket arm 150 to thereby fix the bracket arm 150 in a locked position.

Figure 6:
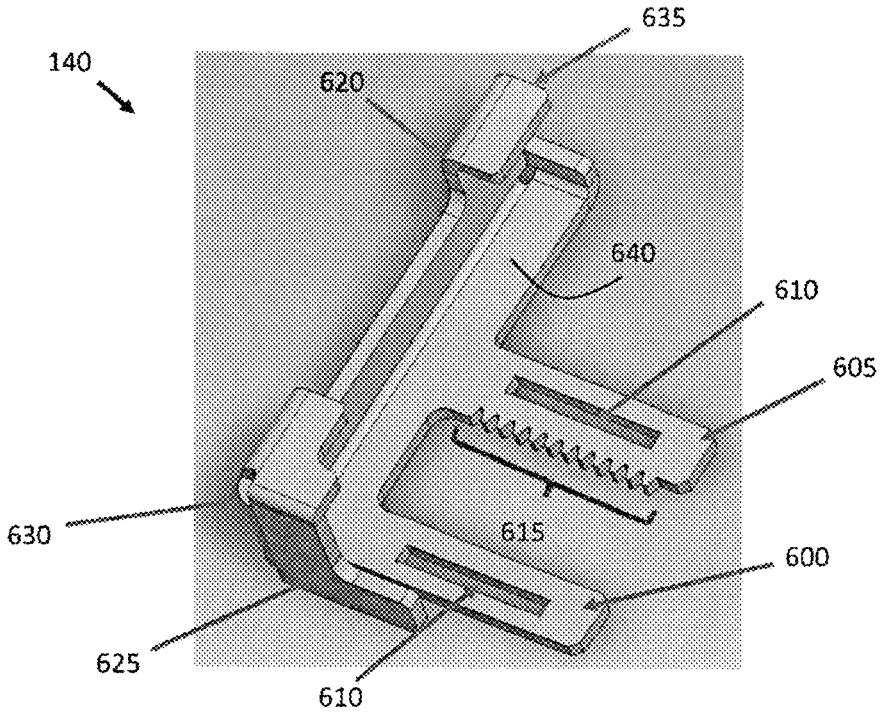
FIGS. 6, 7, and 8 illustrate examples of first, second, and third bracket arms, respectively, that can be used by an example adjustable bracket.

Turning now to FIG. 6, an example embodiment of bracket arm 140 is shown. Overall, bracket arm 140 can exhibit a generally F-shaped design. For example, bracket arm 140 may include a first portion 600 and a second portion 605 that extend outwardly (in the direction of the product width dimension) from a third portion 640 (where third portion extends in the direction of the product length dimension). Members 600, 605, and 640 are dimensioned so that bracket arm 140 exhibits the general shape of the letter F. In an alternative implementation, the bracket arm 140 may have a general T shape where only one of the portion 605 extends from portion 640 (in which case such single portion would include slot 610 and bracket arm teeth 615. Still other shapes and dimensions for bracket arm 140 are possible.

In the example of FIG. 6, portions 600 and 605 are of similar lengths. Each portion 600 and 605 contain slots 610 for receiving guide rails 405. Thus, the bracket arm 140 extends and retracts as the bracket 110 is adjusted, the slots 610 will permit movement of the bracket arm 140 relative to guide rails 405 up to the dimensional extent of slots 610.

FIG. 6 shows an example where portion 605 has a set of first bracket arm teeth 615 that faces gear 315. The bracket arm teeth 615 are pointed in this example embodiment, but other shapes and sizes may be used. Bracket arm teeth 615 are arranged to mate with the corresponding teeth on gear 315 when the bracket arm 140 is positioned inside the bracket 110. Rotation of the gear 315 thus allows the gear to grip bracket arm teeth 615 and drive the bracket arm 140 so that bracket arm 140 extends or retracts based on the direction of rotation for gear 315. While the Example of FIG. 6 shows bracket arm teeth 615 being included as part of portion 605, it should be understood that the bracket arm teeth 615 could instead be positioned on portion 600.

Bracket arm 140 may also include wall portions 620 and 625 that provide for engagement with sides of the electronic device 130. Wall portion 620 can engage with one of the sides of the electronic device 130 along the product length dimension, and wall portion 625 can engage with one of the sides of the electronic device along the product width dimension. An upper part of wall portion 620 may include a portion 635 that defines a general U-shape for part of the bracket arm 140 to help prevent the electronic device 130 from being lifted out of the bracket 110. Similarly, a corner portion 630 of bracket arm 140 (where wall portion 620 meets wall portion 625) can also include a portion that covers part of the top surface of the electronic product to help prevent the electronic device 130 from being lifted out of the bracket 110. These configurations give bracket arm 140 the ability to contact and secure the electronic device 130 on three exposed sides. If desired, a practitioner could also design bracket arm 140 so that bracket arm 140 engages with a bottom surface portion of the electronic device 130 to secure the electronic device 130 on four exposed sides. embodiment shown by FIG. 6, the coverage of the top surface of the electronic device 130 provided by portions 635 and corner 630 need not be continuous but can placed at select distances apart. Furthermore, the cover portions may be located at locations other than at corner 630 and portion 635 (for example, at more inner spaces along the product length and width dimensions). In some example embodiments, foam, rubber, or other protective surfaces may be added to parts of the bracket arm 140 that engage with the electronic device 130 to help protect the electronic device 130 from potential damage as it is secured within the bracket 110.

Figure 7:
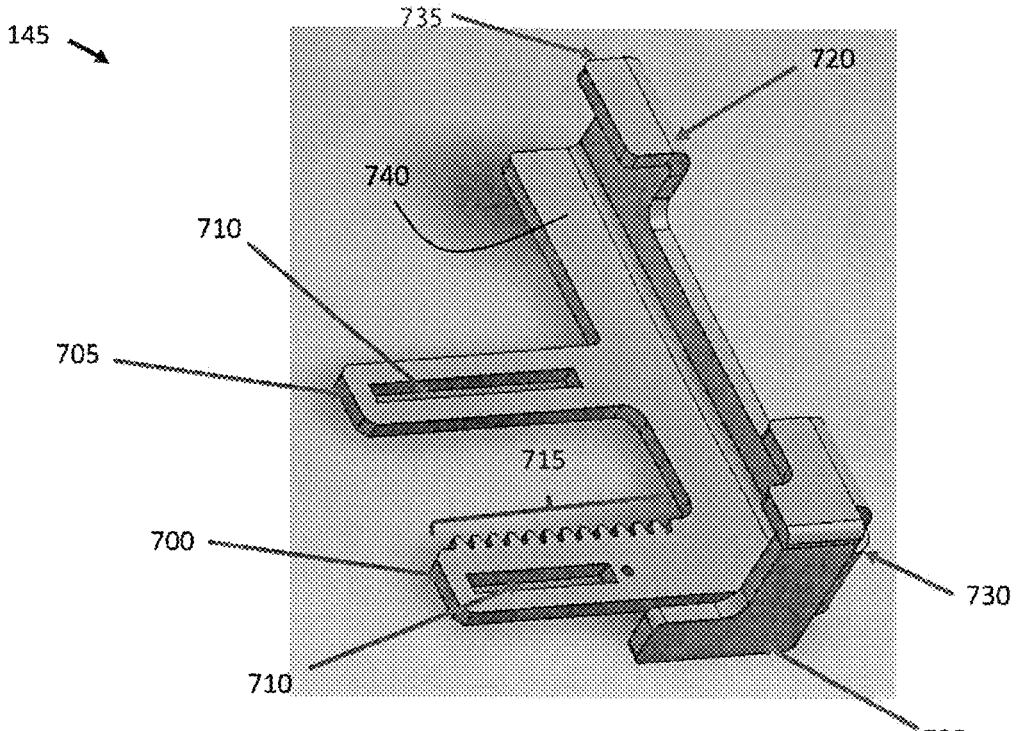

Turning now to FIG. 7, bracket arm 145 can be a complementary version of bracket arm 140, but dimensioned for securing the opposite side of the electronic device 130 along the product length dimension. Accordingly, portions 700, 705, and 740 can be complementary versions of 600, 605, 640. Similarly, slots 710 and the second set of bracket arm teeth 715 can be complementary versions of 610 and 615. However, if a single gear 315 is employed, it should be understood that (1) for an example embodiment where bracket arm teeth 615 are on portion 605, then bracket arm teeth 715 will be on portion 700, and (2) for an example embodiment where bracket arm teeth 615 are on portion 600, then bracket arm teeth 715 will be on portion 705. Furthermore, wall portions 720, 725, cover portion 735, and corner portion 730 can be complementary versions of 620, 625, 635, and 630. Bracket teeth 715 are arranged to mate with teeth on gear 315 when the bracket arm 145 is secured within the bracket 110. Rotation of the gear 315 thus allows the gear to grip bracket arm teeth 715 and drive the bracket arm 145 so that bracket arm 145 extends or retracts based on the direction of rotation for gear 315. Furthermore, wall portions 720, 725, cover portion 735, and corner portion 730 can be complementary versions of 620, 625, 635, and 630.

FIG. 8 shows an example embodiment of bracket arm 150. Bracket arm 150 may include sidewalls which can serve as rails 800 and 805 that extend from a center portion 810 in a spaced relationship so that rails 800, 805 align within corresponding track slots 430 of the bottom plate 160. In the example of FIG. 8, rails 800, 805 extend downwardly from center portion 810. Rails 800, 805 guide the extension/retraction of bracket arm 150 as it is pulled or pushed for adjustment to fit the product length dimension of electronic device 130.

Rail 800 in this example faces lock 155, and rail 800 includes a plurality of lock fittings 815. In this example, the lock fittings 815 take the form of apertures in the shape of partially overlapping circles as shown by FIG. 8. Each of these apertures can receive a piston 1100 of lock 155 (see FIG. 11) to lock the bracket arm 150 at a desired position. While the example of FIG. 8 shows a partially overlapping circle configuration for lock fittings 815, it should be understood that different sizes and shapes for the lock fittings 815 could be used based on the nature of lock 155. When lock 155 is in a locked state, lock 155 will engage and enter one of the circular apertures to lock bracket arm 150 in place. When the lock 155 is unlocked, lock 155 will no longer engage with any of the circular apertures, and the bracket arm 150 will be free to extend/retract as desired by a user.

A blocking tab 825 may be positioned at a desired location along the product length dimension of bracket arm 150 to define a maximum extent of extension for bracket arm 150. For example, blocking tab 825 can be positioned at the proximal end of center portion 810 (the end that is opposite portion 835 for engaging with the electronic device 130). When the bracket 110 is assembled and the bracket arm 150 is extended or retracted, the blocking tab 825 abuts the stop 411 or 410, which prevents the bracket arm 150 from being extended to the point where it separates from bottom plate 160 or from colliding with the portions 605 and 705 of the bracket arms 140 and 145.

The distal end portion 830 of the bracket arm 150 may include a wall portion 835 and cover portion 840 that provide for engagement with the electronic device 130. Center portion 810, wall portion 835, and cover portion 840 can exhibit a generally sideways U-shaped configuration. This shape gives bracket arm 150 the ability to contact and secure the electronic device 130 on at least two exposed sides. The bracket arm 150 may also engage with a bottom surface portion of the electronic device 130 to secure the electronic device 130 on three exposed sides. In an example embodiment, this sideways U-shaped configuration of the bracket arm 150 will be located near the midpoint of the product width dimension of the electronic device 130 to provide stabilized security when the electronic device 130 is held within the bracket 110. In some example embodiments, foam, rubber, or other protective surfaces may be added to parts of the bracket arm 150 that engage with the electronic device 130 to help protect the electronic device 130 from potential damage as it is secured within the bracket 110.

Figure 13:
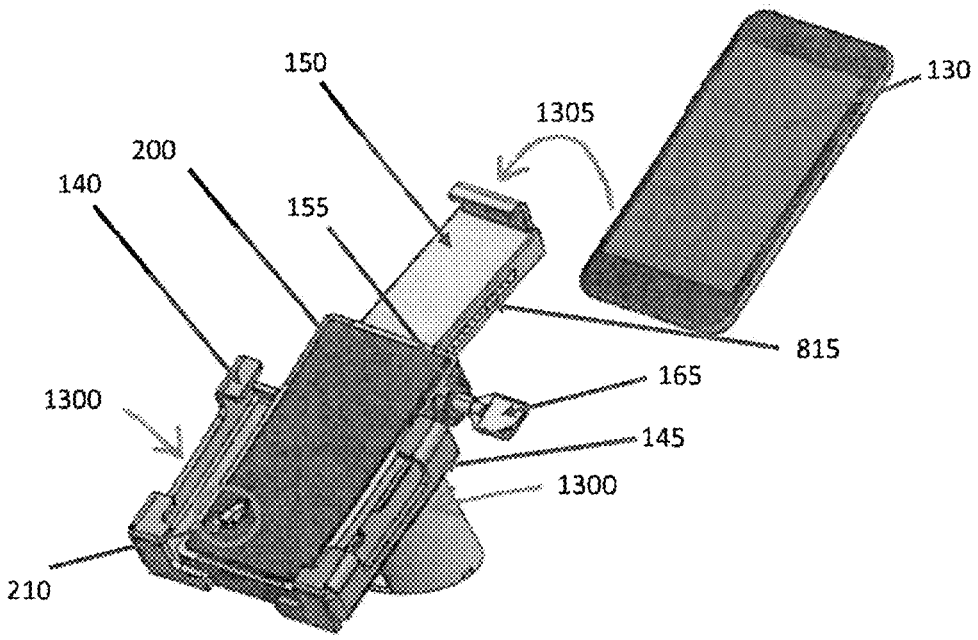
FIG. 13 illustrates how an electronic device can be placed within an example adjustable bracket.

Furthermore, the open space within the bottom plate 160 within which bracket arm 150 fits can be dimensioned so to provide some tolerance play for vertical deflections of the bracket arm 150 when the bracket arm 150 is in certain extended positions. For example, if the bracket arm 150 is sufficiently extended outward, a downward force can be applied to the bracket arm 150 to deflect the bracket arm 150 downward in a manner that permits electronic device 130 to be more easily slide within the bracket 110 by providing more clearance between the U-shaped distal end of bracket arm 150 and the electronic device. As an example, this downward force can be provided by gravity. An example of downward deflection for bracket arm 150 is shown by FIG. 13. This tolerance play can be achieved by providing some clearance for the bracket arm 150 between the top plate and bottom plate for certain extensions of the bracket arm 150. For example, proximal portions of the interior chamber of the bottom plate 160 can have a narrower dimension that does not permit for deflection of the bracket arm 150 while more distal portions of the interior chamber of bottom plate 160 can have a larger dimension that permits such deflection. Top plate 300 and/or bottom plate 160 can be shaped to provide such varying dimensions.

Figure 9:
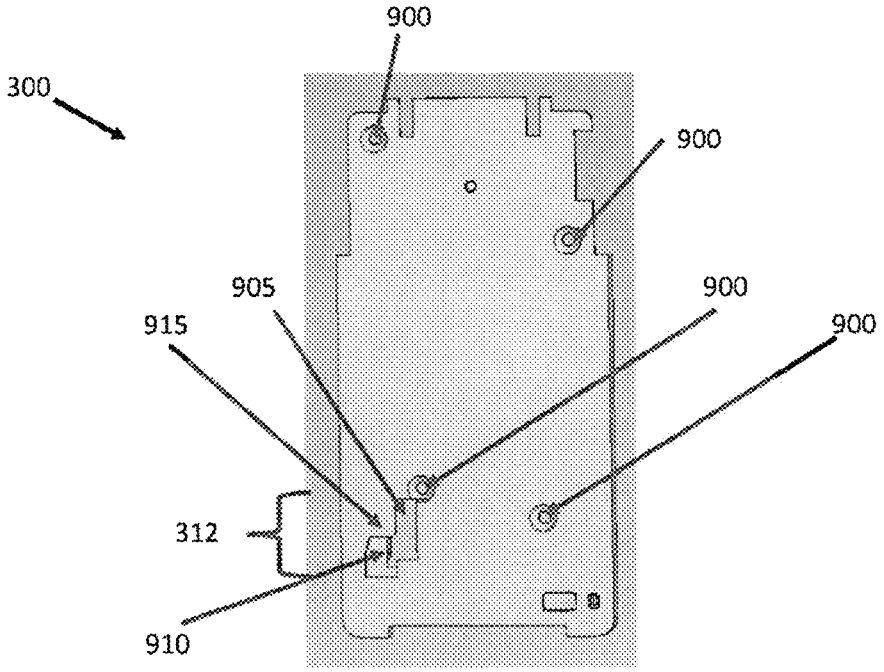
FIG. 9 illustrates a top down view of an example top plate for an example adjustable bracket.

FIG. 9 illustrates a top-down view of an example top plate 300. The upper surface of top plate 300 may be generally flat and may include a plurality of fastener openings 900 that allow for insertion of fasteners 310 to secure the top plate 300 to the bottom plate 160.

Top plate 300 also includes top plate opening 312. The top plate opening 312 allows for a portion of the lock 210 to protrude through the top plate 300. The top plate opening 312 has a first slot 905 and a second slot 910, where slots 905 and 910 are adjoining but laterally spaced. Slots 905 and 910 can be generally rectangular in shape. In the example of FIG. 9, slot 910 is offset with respect to the slot 905 and is smaller in size and shape. Lock 210 can move within the bottom plate 160 based on the positions and shapes of slots 905 and 910, and the lock 210 provides for three positional states—an unlocked position, a first locked position, and a second locked position.

When lock 210 is in the unlocked position, bracket arms 140 and 145 can be extended/retracted. In the example of FIG. 9, the lock 210 can be in the unlocked position when its upper portion is aligned with slot 905. In this circumstance, spring 320 will bias lock 210 to an upward position where lock 210 does not engage gear 315 (as discussed below), placing the lock 210 in the unlock position.

When lock 210 is in the first locked position, bracket arms 140 and 145 cannot be extended/retracted, and the lock 210 will remain in the first locked position only if an external force is applied to the upper portion of lock 210 to hold the lock 210 in a downward position. Otherwise, the bias force of spring 320 would return lock 210 to the unlocked position. In the example of FIG. 9, the lock 210 can be in the first locked position when its upper portion is aligned with slot 905.

When lock 210 is in the second locked position, bracket arms 140 and 145 cannot be extended/retracted, and the lock 210 will remain in the first locked position even if no external force is applied to the upper portion of lock 210 to hold the lock 210 in a downward position. In the example of FIG. 9, the lock 210 can be in the first locked position when its upper portion is aligned with slot 910. Because of the dimensions of slot 910, portion 915 of top plate 300 will block upward movement of lock 210 and hold the lock 210 downward against the bias force of spring 320 so that lock 210 remains engaged with gear 315, preventing rotation of the gear 315. In an example embodiment, when in the second locked position, the lock 210 is tilted/tipped into slot 910 and where the lock 210 is shaped in a manner so that the lock teeth (see 1010 in FIGS. 10A-10C) remain engaged with the gear teeth see 1200 in FIG. 12) while the upper portion of tilted lock 210 is held in place within slot 910 by portion 915 of top plate 300. For example, the lock 210 can be tilted at an angle of around 30 degrees when in the second locking position, and spring 320 can permit such tilting of lock 210 while still holding the lock 910 in position.

Thus, lock 210 provides users with a number of options for locking bracket arms 140, 145. With a first option, the lock 210—when in the unlocked state—can be actuated into a locked state simply by inserting the electronic device 130 into the bracket 110 so that the electronic device 130 pushes downward on lock 210 to move the lock 210 into the first locked position. Accordingly, while the lock 210 is unlocked, the user can adjust bracket arms 140 and 145 as necessary to fit the electronic device 130, and then slide the electronic device 130 into the bracket 110 to automatically transition the lock 210 into a locked state that prevents further adjustments of bracket arms 140, 145. With a second option, the lock 210—when in the unlocked state—can be actuated into a locked state by a user pressing downward on the lock 210 to move the lock 210 into the first locked position and then sliding the lock 210 over into slot 910 to transition lock 210 to the second locked position. This may be desirable in instances where the user wants to remove the electronic device 130 from the bracket 110 by unlocking bracket arm 150 using lock 155 and extending bracket arm 150 to a position where the electronic device 130 can be removed from the bracket 110. In this scenario, the user may want to keep bracket arms 140, 145 in their current positions for a later re-insertion of that electronic device 130 (or the insertion of a new electronic device with the same dimensions as the removed electronic device). Because lock 210 is in the second locked position, removal of the electronic device 130 would not return lock 210 to an unlocked state. To unlock the lock 210 when it is in the second locked position, a user may simply slide the lock 210 over to slot 905, whereupon it will return to the unlocked position if downward force is removed from the lock 210.

Figures 10A, 10B, 10C:
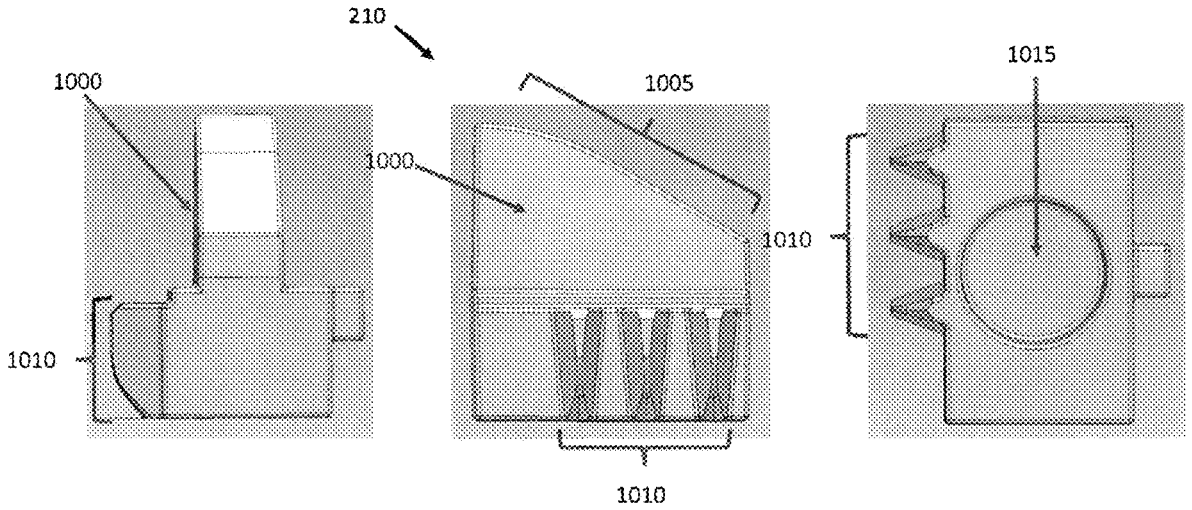
FIGS. 10A, 10B, and 10C illustrate views of an example lock for locking the first and second bracket arms.

FIGS. 10A, 10B, and 10C show an example embodiment for lock 210. FIG. 10A is a front view of an example lock 210. FIG. 10B is a side view of the example lock 210, and FIG. 10C is a bottom view of the example lock 210. Upper portion 1000 of lock 210 can protrude through the top plate opening 312 (and the top plate cover opening 205 if a top plate cover 200 is used) when lock 210 is in the unlocked state. Upper portion 1000 can push the lock 210 downward in response to forces applied to upper portion by the electronic device 130 or a user (via the user's fingers or a tool used by the user). Upper portion 1000 can have a sloped surface 1005. Such a sloped surface 1005 permits the sliding action of the electronic device 130 into the bracket 110 to more smoothly deflect lock 210 downward. The sloped surface 1005 also provides for a dimension that allows slot 910 to receive lock 210 while portion 915 blocks upward movement of lock 210 back to an unlocked state.

To provide the locking action, the lock 210 may have a set of locking teeth 1010. The locking teeth 1010 are pointed in this example embodiment, but other shapes and sizes for locking teeth 1010 may be used. The set of locking teeth 1010 are arranged to mate with the gear teeth of gear 315 to prevent rotation of the gear 315 when the lock 210 is in a locked state. By blocking the rotation of gear 315, locking teeth 1010 can thus prevent extension/retraction of bracket arms 140, 145. When the lock 210 is depressed, the locking teeth 1010 move in a downward direction to mate with the gaps between the gear teeth of gear 315, thus blocking rotation of gear 315 because lock 210 cannot rotate due to space constraints within the bracket 110. When the lock 210 is in the unlocked state, the bias force of spring 320 will move locking teeth 1010 upward so that they no longer mate with the teeth of gear 315. With such disengagement between locking teeth 1010 and gear teeth of gear 315, the gear 315 is once again free to rotate (which means that bracket arms 140, 145 can be extended/retracted as desired).

To assist in movement between locked and unlocked states, the lock 210 can include a spring holder 1015. The spring holder 1015 may be a depression in the bottom surface of the lock 210 and be of a suitable diameter to accept and hold the spring 320.

It should be understood that gear 315 can be designed to have a sufficient height so that its gear teeth can mate with both bracket arm teeth 615, 715 and with locking teeth 1010. Furthermore, while the example of FIGS. 10A-10C show multiple locking teeth 1010, a practitioner may find it suitable to employ a single locking tooth or pin that can insert itself between the gear teeth or other aperture in the gear 315 to prevent its rotation when the lock 210 in a locked state. However, in an another example embodiment, the locking teeth 1010 of lock 210 can be positioned on the lock 210 so that they mate and engage with either bracket arm teeth 615 or bracket arm teeth 715 when the lock 210 is in a locking position because preventing movement of one of the bracket arms 140, 145 will also be effective to block movement of both bracket arms 140, 145 if both bracket arms 140, 145 share the same gear 315.

Figure 11:
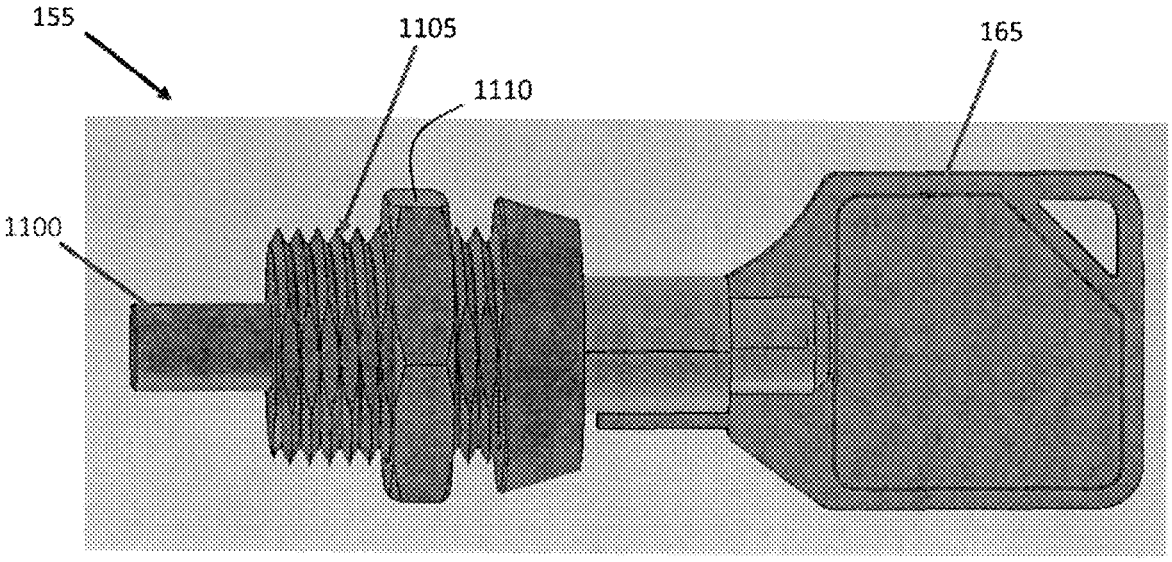
FIG. 11 illustrates an example lock for locking the third bracket arm.

FIG. 11 shows an example embodiment for lock 155 where lock 155 comprises a barrel lock. The barrel lock is but one possible type of lock that may be used for lock 155. Other types of locks 155 are possible. The barrel lock 155 may comprise an externally threaded barrel 1105 that fits within an internally threaded ring 1110. Piston 1100 can extend from a distal end of the barrel 1105, and a tool interface can be positioned at a proximal end of the barrel 1105 (from the perspective of a user). As a tool such as a key 165 is used to rotate barrel 1105 within the ring 1110, the threading will drive the barrel 1105 and piston 1100 either forward or backward depending on the direction of rotation. To move the barrel lock to a locked state, the key 160 can rotate the barrel 1105 until piston 1100 engages with one of the lock fittings 815 (which lock fitting 815 is engaged will depend on the position of bracket arm 150) to thereby lock bracket arm 150 at a desired position. To unlock the barrel lock, the key 165 can counter-rotate the barrel 1105 so that piston 1100 disengages from the lock fittings 815, thereby freeing the bracket arm 150 for further extension/retraction.

Figure 12:
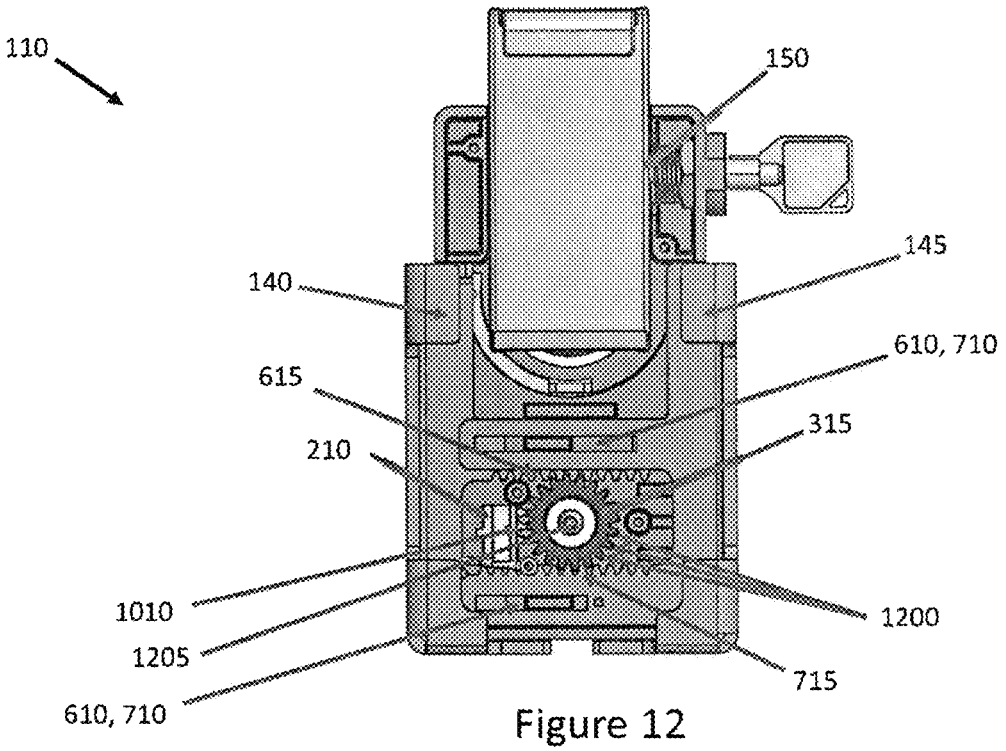
FIG. 12 illustrates a view of an example adjustable bracket with the top plate removed.

FIG. 12 shows an example embodiment of the assembled bracket 110 but with the top plate 300 (and top plate cover 200) omitted to reveal how the components fit together. In this view, gear teeth 1200 around the periphery of the gear 315 mate with bracket arm teeth 615, 715. In the example of FIG. 12, a single gear 315 is used to engage the bracket arm teeth 615, 715 of both bracket arm 140 and bracket arm 145. Accordingly, a user may push or pull only one of the bracket arms 140, 145 to cause an adjustment of both bracket arms 140 and 145 because rotation of the gear 315 will drive both bracket arms 140 and 145. Accordingly, users can adjust bracket arms 140, 145 in tandem as a pair by interacting with only one of the bracket arms 140, 145. For example, for the example view of FIG. 12, if bracket arm 140 were pulled outward to expand the bracket 110 to accommodate a larger width electronic device 130, the gear 315 would rotate in a counter clockwise direction. Since the gear teeth 1200 engage with both bracket arm teeth 615 and bracket arm teeth 715, this means that bracket arm 145 would also move an equal distance outward as that of bracket arm 140. Likewise, for the example view of FIG. 12, if the bracket arm 140 were pushed inward to retract the bracket 110 to fit a smaller width electronic device 130, the gear 315 would rotate in a clockwise direction. Since the gear teeth 1200 engage with both bracket arm teeth 615 and bracket arm teeth 715, this means that bracket arm 145 would also move an equal distance inward as that of bracket arm 140. This equal tandem movement by bracket arms 140 and 145 creates an auto-centering feature for the bracket 110. Regardless of how far one of bracket arms 140 or 145 is extended or retracted, the other bracket arm 140, 145 will do the same so that the midpoint between the edges of bracket arms 140 and 145 always remains in the same location on bracket 110 (preferably the midpoint along the product width dimension of the electronic device 130). Thus, any electronic device 130 secured by the bracket 110 will always be centered along its product width dimension while snugly fitted within the bracket 110. This centered appearance helps enhance security by preventing positioning of the electronic device 130 within the bracket 110 at a possible weak un centered position (and also adds customer appeal by giving the electronic device 130 a pleasing symmetrical display).

Additionally, FIG. 12 shows an example where bracket arm 140 is positioned below bracket arm 145. However, other example embodiments may have this positioning reversed.

FIG. 13 illustrates an example of how the electronic device 130 can be placed into the bracket 110 of the merchandise security system 100. FIG. 13 shows bracket 110 in a semi-open and unlocked state for each of bracket arms 140, 145, 150. Bracket arm 150 is fully extended and has been deflected downward to provide more clearance for inserting electronic device 130 into the bracket 110. Bracket arms 140 and 145 are in a slightly extended position to accommodate the product width dimension of the electronic device 130. Lock 210 is in an elevated and thus unlocked position. To operate the bracket 110, a user may first adjust 1300 the brackets arms 140 and 145 to accommodate the width of the electronic device 130. As discussed above, this can be accomplished by only extending or retracting either one of brackets arms 140 or 145. Once the desired width for bracket arms 140 and 145 is set, the user can choose to actuate lock 210 to either the first locked position or the second locked position to fix bracket arms 140 and 145 at the desired width position, where this actuation can be provided by the electronic device 130 itself or by the user pressing on the lock 210 and moving it to either the first or second locked positions). If further adjustment of bracket arms 140, 145 is desired, the user can slide the electronic device 130 so that electronic device 130 does not block slot 905, and the lock 210 can then return to the unlocked state (if the lock 210 was in the first locked position, the lock 210 will automatically return to the unlocked state once the electronic device is removed from covering slot 905; and if the lock 210 was in the second locked position, the lock 210 can be shifted by the user from slot 910 back to slot 905 where the bias force of spring 320 can return the lock 210 to an unlocked state). Once unlocked, the user can further adjust the bracket arms 140, 145 to better fit the device 130. Afterwards, the user can then simply slide the electronic device 130 further down to push down on lock 210 and re-lock bracket arms 140, 145 at the desired position (or the user can move lock 210 to the second locked position before sliding device 130 back down. After the electronic device 130 is secured in this manner, the user may retract bracket arm 150 by pushing on it to snugly fit onto the electronic device 130. Once bracket art 150 is in the desired position, the user can rotate the key 165 to actuate lock 155 and thereby block bracket arm 150 from further adjustments. At this point, the electronic device 130 is secured and cannot be removed from the bracket 110 without first using the key 165 of lock 155 (e.g., see FIG. 1).

The embodiments were chosen and described in order to best explain the principles of the invention and its practical application to thereby enable others skilled in the art to best utilize the invention in various embodiments and with various modifications as are suited to the particular use contemplated.

As various modifications could be made in the construction and method herein described and illustrated without departing from the scope of the invention, it is intended that all matter contained in the foregoing description or shown in the accompanying drawings shall be interpreted as illustrative rather than limiting. For example, different locking mechanism, different types of barrel locks, and different types of bracket designs may be employed but can achieve the same functionality of the underlying invention. Thus, the breadth and scope of the present invention should not be limited by any of the above-described example embodiments, but should be defined only in accordance with the following claims appended hereto and their equivalents.

The invention claimed is:

1. An apparatus comprising:

an adjustable bracket for securing a product, the bracket comprising:

an adjustable bracket arm with bracket arm teeth;

a gear with gear teeth that mates with the bracket arm teeth;

a base having a top plate for receiving the product, the top plate having a top plate opening; and a lock having locking teeth and an upper portion that protrudes through the top plate opening;

wherein the adjustable bracket arm extends outward from the base and is adapted to engage with a portion of the product to facilitate securing the product to the base, wherein the lock transitions between an unlocked state and a locked state to control whether the adjustable bracket arm can be extended and retracted relative to the base, wherein the adjustable bracket arm is extendable and retractable relative to the base when the lock is in the unlocked state, and wherein the adjustable bracket arm is not extendable or retractable relative to the base when the lock is in the locked state, and wherein when the product is placed on the top plate, the product pushes down on the upper portion causing the locking teeth to mate with the gear teeth, thereby transitioning the lock from an unlocked state to a locked state.

2. The apparatus of claim 1 wherein the lock includes a spring that biases the lock to the unlocked state, and wherein the spring is compressed in response to the product pushing down on the upper portion.

3. The apparatus of claim 1 wherein the lock is adapted to transition from the locked state to the unlocked state in response to a removal of the product from the surface in a manner that causes the product to disengage from the lock.

4. The apparatus of claim 1 wherein the upper portion extends above the top plate when the lock is in the unlocked state, and wherein an engagement between the product and the upper portion causes a downward movement of the lock relative to the surface.

5. The apparatus of claim 1 wherein the base comprises a bottom plate, wherein the lock includes another lock portion that resides within the bottom plate, wherein the downward movement of the lock causes the lock to move to a locked position that prevents extension and retraction of the adjustable bracket arm.

6. The apparatus of claim 1 wherein the gear resides within a bottom plate, the gear being rotatable around an axis, wherein the gear is positioned to engage with the bracket arm teeth of the adjustable bracket arm that resides within the bottom plate, wherein rotation of the gear drives extension and retraction of the adjustable bracket arm depending on a direction of rotation for the gear, and wherein the locked position for the lock prevents rotation of the gear.

7. The apparatus of claim 1 wherein the adjustable bracket arm is a first adjustable bracket arm, and wherein the adjustable bracket comprises a second adjustable bracket arm;

wherein the first and second adjustable bracket arms extend outward from different sides of the base and are adapted to engage with different portions of the product to facilitate securing the product to the base; and wherein the lock is transitionable between the locked state and the unlocked state to control whether the first and second adjustable bracket arms can be extended and retracted relative to the base, wherein the first and second adjustable bracket arms are extendable and retractable relative to the base when the lock is in the unlocked state, and wherein the first and second adjustable bracket arms are not extendable or retractable relative to the base when the lock is in the locked state.

8. The apparatus of claim 7 wherein the gear resides within a bottom plate, the gear being rotatable around an axis, wherein the gear is positioned to engage with the bracket arm teeth of the first adjustable bracket arm that resides within the bottom plate and bracket arm teeth of the second adjustable bracket arm that resides within the bottom plate, wherein rotation of the gear drives extension and retraction of the first and second adjustable bracket arms depending on a direction of rotation for the gear, and wherein the locked position for the lock prevents rotation of the gear.

9. An apparatus comprising:

an adjustable bracket for securing a product, the bracket comprising:

a first bracket arm partially contained within a bottom plate of the bracket;

a second bracket arm located opposite the first bracket arm and partially contained within the bottom plate of the bracket;

a gear located within the bottom plate of the bracket, the gear mechanically coupled to each the first bracket min and the second bracket arm to accommodate movement of the first bracket arm and the second bracket arm;

a lock, the lock partially contained within the bottom plate of the bracket and operable to place the bracket in a locked position or an unlocked position; and wherein when the bracket is in the locked position, the lock mechanically engages the gear to prevent movement of each the first bracket arm and the second bracket arm, wherein the lock may be placed into the locked position by depressing a top portion of the lock, the top portion protruding through an opening of the bottom plate and placed against a notch of the bottom plate.

10. The apparatus of claim 9, wherein the gear mechanically engages and accommodates movement of the first bracket arm and the second bracket arm.

11. The apparatus of claim 9, wherein the first bracket arm contains a set of first bracket arm teeth to mechanically engage the gear.

12. The apparatus of claim 9, wherein the second bracket arm contains a set of second bracket arm teeth to mechanically engage the gear.

13. The apparatus of claim 9, wherein the first bracket arm has a first member and a second member.

14. The apparatus of claim 9, further comprising a second lock, the second lock mechanically engaging at least one of the plurality of lock fittings to secure a position of a third bracket arm partially contained within a bottom plate of the bracket.

15. A method of securing a product to an adjustable bracket, the method comprising:

adjusting a width of a bracket assembly of the bracket to accommodate a first dimension of the product, the bracket assembly comprising a first bracket arm and a second bracket arm;

adjusting a third bracket arm of the bracket to accommodate a second dimension of the product, wherein the second dimension is perpendicular to the first dimension;

placing the product within the bracket assembly to rest on a base of the bracket;

contracting the third bracket arm to securely fit the product; and activating a first lock to secure the third bracket arm, wherein the bracket further comprises a second lock, and wherein placement of the product within the bracket to rest on the base depresses the second lock to lock the bracket assembly, thereby securing the product within the bracket.

16. The method of claim 15, further comprising a lock protector protruding outward from the bottom plate to encompass the lock for the third bracket arm.

17. The method of claim 15, wherein adjusting the width of the bracket assembly comprises moving the first bracket arm in a first direction, which thereby causes an equal movement on the second bracket arm in a second direction that is opposite the first direction.

* * * * *